US005501361A

United States Patent [19]

DeMordaunt

[11] Patent Number: 5,501,361

[45] Date of Patent: Mar. 26, 1996

[54] DOCUMENT PRESERVATION SYSTEM

[76] Inventor: Jeff P. DeMordaunt, 2502 Park St., Rolling Meadows, Ill. 60008

[21] Appl. No.: 266,167

[22] Filed: Jun. 27, 1994

Related U.S. Application Data

[63] Continuation of Ser. No. 52,156, Apr. 22, 1993, abandoned.

[51] Int. Cl.[6] ..... B65D 85/00

[52] U.S. Cl. ..... 220/529; 206/523

[58] Field of Search ..... 220/529, 530, 220/552, 553, 554; 206/444, 523

[56] References Cited

U.S. PATENT DOCUMENTS

| | | | |
|---|---|---|---|
| 1,896,761 | 2/1933 | Wheary et al. | 206/523 X |
| 2,176,284 | 10/1939 | Whiteford . | |
| 2,226,519 | 12/1940 | Larsen . | |
| 4,093,010 | 6/1978 | Hunley et al. | 206/523 X |
| 4,120,441 | 10/1978 | Hurley . | |
| 4,602,715 | 7/1986 | Sarver et al. | 206/523 |
| 4,884,692 | 12/1989 | Middlebrooks | 220/529 X |
| 4,896,428 | 1/1990 | Peterson . | |
| 4,957,213 | 9/1990 | White et al. . | |
| 5,011,072 | 4/1991 | Ludwig . | |
| 5,092,062 | 3/1992 | Palka . | |
| 5,097,953 | 3/1992 | Gingras . | |
| 5,147,041 | 9/1992 | Lemieux et al. . | |
| 5,148,942 | 9/1992 | Snook . | |
| 5,154,292 | 10/1992 | Bartucca et al. . | |
| 5,190,127 | 3/1993 | Cummings . | |

*Primary Examiner*—Steven M. Pollard
*Attorney, Agent, or Firm*—Fish & Richardson

[57] ABSTRACT

A container and method for containing documents which protects documents from damage by suspending the corners of the documents from the container's surfaces through an integral or attached mid-portion lining or raised surface. This lining or raised surface may be made of pliant material having a texture which prevents slippage of the document within the container.

10 Claims, 3 Drawing Sheets

DOCUMENT PRESERVATION SYSTEM

This application is a file wrapper continuation of U.S. application Ser. No. 08/052,156, filed Apr. 22, 1993, now abandoned.

BACKGROUND OF THE INVENTION

1. Field of the Invention

The present invention relates generally to containers used to store and preserve documents. In one embodiment, the present invention relates to a device for storing multiple cards which minimizes damage from contact with the storage device.

2. Discussion of the Related Art

Containers of various shapes and sizes are typically used to store and/or transport documents such as imprinted cards. Such cards, commonly known as collector or trading cards, need to be stored in a manner to protect them from damage. Such cards vary in quality and are typically categorized in grades ranging from poor to mint. Preservation of the cards in their original condition enhances their value.

Conventional containers generally hold between 100 and 5,000 cards. Such containers, however, are less than ideal because the cards are free to slide within the container. Since existing containers generally have cross-sectional dimensions greater than the dimensions of the trading cards, the cards are free to move in planes perpendicular and parallel to the longitudinal axis of the container. This movement damages the corners and edges of the trading cards, which decreases their value.

Alternatively, cards are sometimes stored in pockets formed in paper or plastic (e.g., polypropylene) sheets. These sheets are commonly assembled in D-ring binders. Storage in such sheets is expensive and does not protect the cards as well as a rigid container. For example, the corners of the card can be creased when the card is inserted into the polypropylene page. Furthermore, such sheets are bulky, consuming much space.

Rigid containers are also known for protecting individual cards. While these containers protect the cards from bending and twisting, they offer no system for organizing the cards in a logical order. Also, only one card is protected by each rigid container. Thus, protecting a large collection of cards with individual rigid containers is expensive. Furthermore, each rigid container adds considerably to the space required for storage.

In summary, the prior art storage devices that adequately protect trading cards are expensive and bulky, while economical storage devices tend to damage the corners and edges of stored cards.

SUMMARY OF THE INVENTION

This invention provides several advantages over the prior art by providing an inexpensive method and container for safely storing multiple documents. In one embodiment, a mid-portion protrudes from a container wall to prevent contact between the document and the container wall. In another embodiment, the protruding mid-portion is pliant. In another embodiment, at least two protruding mid-portions engage opposite edges of a stored document.

In another embodiment, an improved method of storing multiple documents is provided. The improved method involves placing a document into a container with a wall having a protruding mid-portion. Another embodiment provides attaching a support member to a container wall to create a protruding mid-portion. Yet another embodiment involves placing documents in a container with protruding mid-sections and placing the documents in slight compression upon closing the container.

BRIEF DESCRIPTION OF THE DRAWING

For detailed understanding of the present invention, reference should be made to the following detailed description, taken in conjunction with the accompanying drawings, in which like elements have been given like numerals, and wherein.

DETAILED DESCRIPTION OF THE PREFERRED EMBODIMENT

Figure 1:
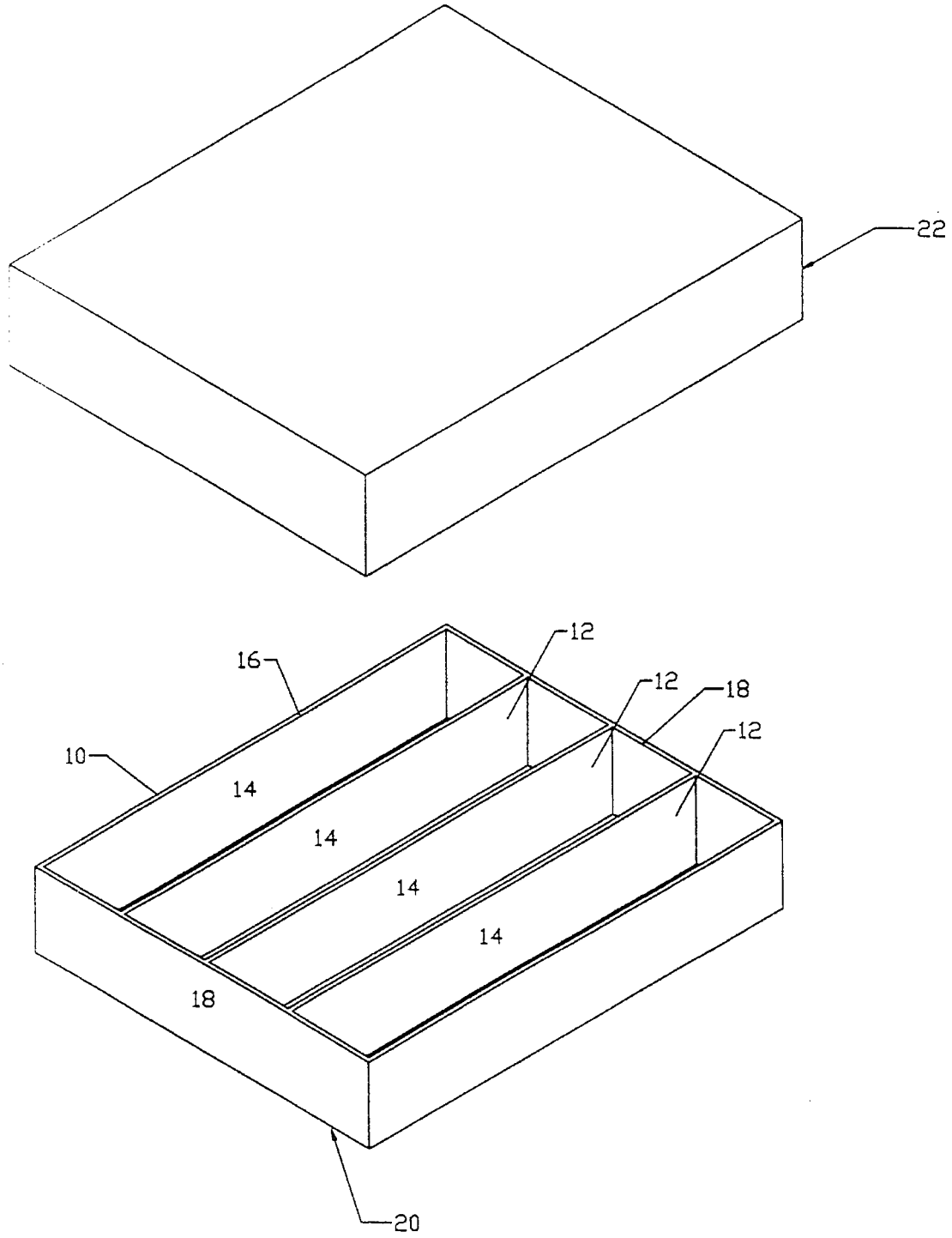
FIG. 1 is a perspective view of a conventional card containing device.

While this invention is susceptible of embodiment in many different forms, there is shown in the drawings and described in detail herein a preferred embodiment. The present disclosure is intended to be an exemplification of the principles of the invention, generally, and a preferred embodiment, specifically, and should not be construed to limit the invention to the embodiments illustrated.

FIG. 1 illustrates a conventional container. The interior of a rectangular box 10 is subdivided by a plurality of partitioning walls 12 to form a plurality of chambers 14. The partitioning walls 12 and the exterior walls of the box 16 are perpendicular to the ends of the box 18, and the partitioning walls 12 and the exterior walls of the box 16 are perpendicular to the bottom of the box 20. A lid 22 sealingly engages the perimeter of the rectangular box 10.

Documents, such as cards, are stored and transported within the chambers 14 of these rectangular boxes 10. In transporting and storage, the documents may move relative to the lid 22, exterior walls 16, partitioning walls 12 and bottom 20 of the box. Such movement causes wear on the corners and edges of the documents. Typically, trading cards are slightly smaller in dimension than the cross section of the chamber 14. Thus, even if the chamber 14 is tightly packed with cards, movement of the cards relative to the chamber 14 is possible in two directions: up and down and side-to-side. The walls forming the chamber 14 are typically constructed of rigid material such as cardboard or plastic. Such surfaces are abrasive on the edges and corners of the cards.

Figure 2:
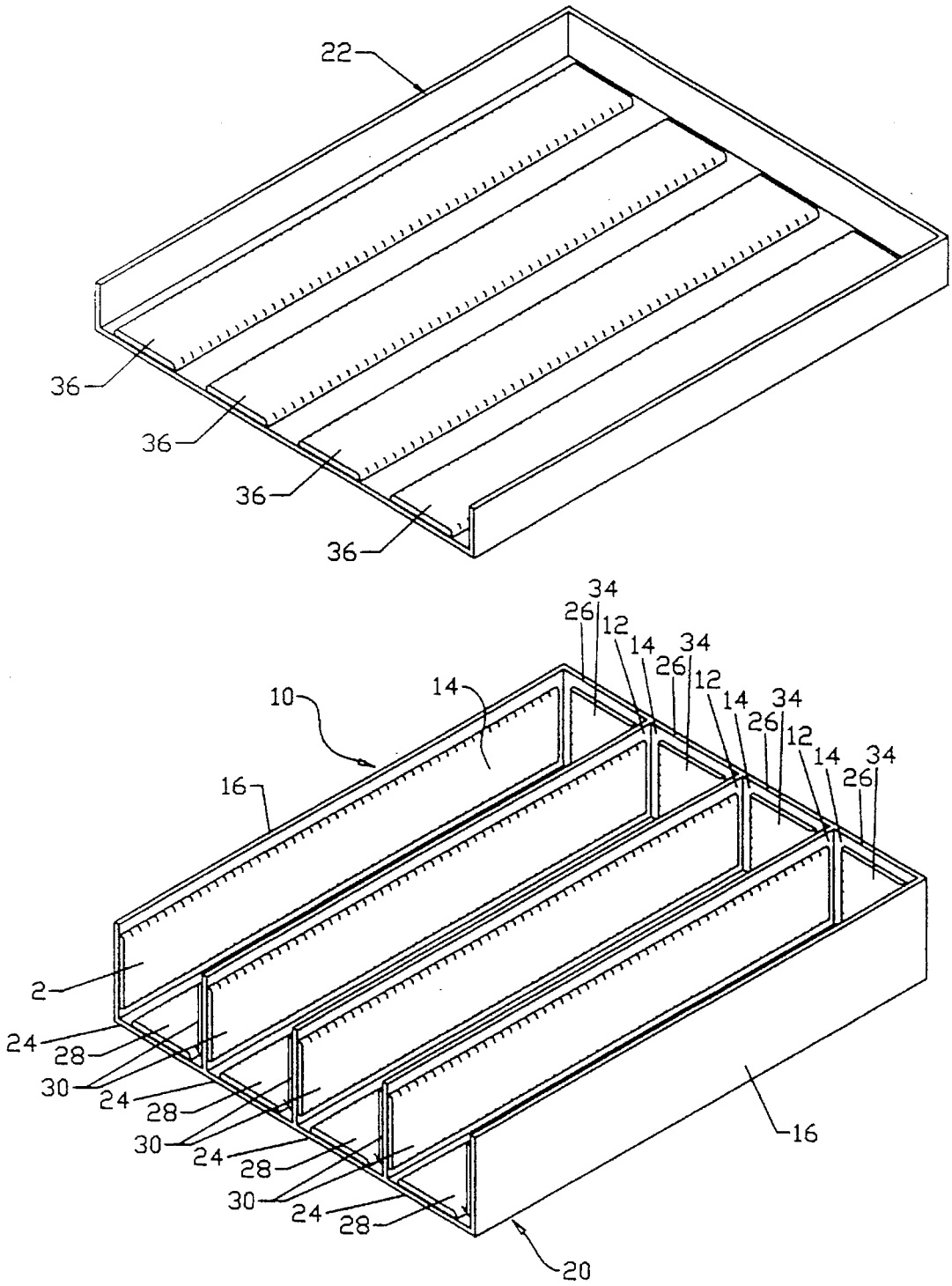
FIG. 2 is a cut away perspective view of one embodiment of the present invention.

FIG. 2 illustrates a container according to the present invention. As can be seen, the bottom of the box 20 forms bottom walls 24, and the end of the box 18 forms end walls 26. These, coupled with the partitioning walls 12, the exterior walls 16 and lid 22, completely define the chambers 14 used for card storage. In this embodiment, each wall has a mid-portion extending or protruding into the chamber 14. The invention does not require a mid-portion protruding from each wall, rather all that is required is that a mid-portion protrude from at least one wall of the chamber 14. Each bottom wall 24 has a bottom wall mid-portion 28, each partitioning wall 12 has a partitioning wall mid-portion 30, each exterior wall 16 has an exterior wall mid-portion 32, and each end wall 26 has an end wall mid-portion 34. When the lid 22 is placed on the rectangular box 10, each chamber 14 has an upper wall formed by the lid 22. Each upper wall has an upper wall mid-portion 36.

The mid-portions serve to distance the card from the walls forming the chamber 14. Thus, cards contact only the mid-portion of each wall, and contact of the cards' corners and edges with the walls of the chamber 14 is thereby prevented.

It will be noted that when the lid 22 is placed on the rectangular box 10, the walls of chamber 14 are substantially perpendicular or parallel to each other. Substantially perpendicular or parallel, as used herein, simply contemplates the general spatial relationship of the walls, as illustrated by FIGS. 2 and 3, when the chamber is closed.

In one embodiment, the mid-portion will be made of a relatively pliant, nonabrasive material. Suitable pliant materials include fabric, felt, padding materials and foams, such as various plastic foams. Polyurethane foam is especially well suited for use as a pliant mid-portion. A pliant mid-portion permits the cards to gently settle into the mid-portion without damaging the edges of the cards. Furthermore, as the cards nestle into the mid-portion, the tendency of the card to move relative to the chamber 14 is reduced. However, it is not necessary that the mid-portion be pliant to practice the invention. The mid-portion can also be constructed of a relatively rigid material, and the advantage of not engaging the cards' corners with the containment device is still enjoyed.

The mid-portion 28 could be formed by connecting a support member to the chamber wall. For example, a support member formed from a strip of adhesive-backed polyurethane foam or other appropriate material could be connected to a planer wall to form the protruding mid-portion 28.

Figure 3:
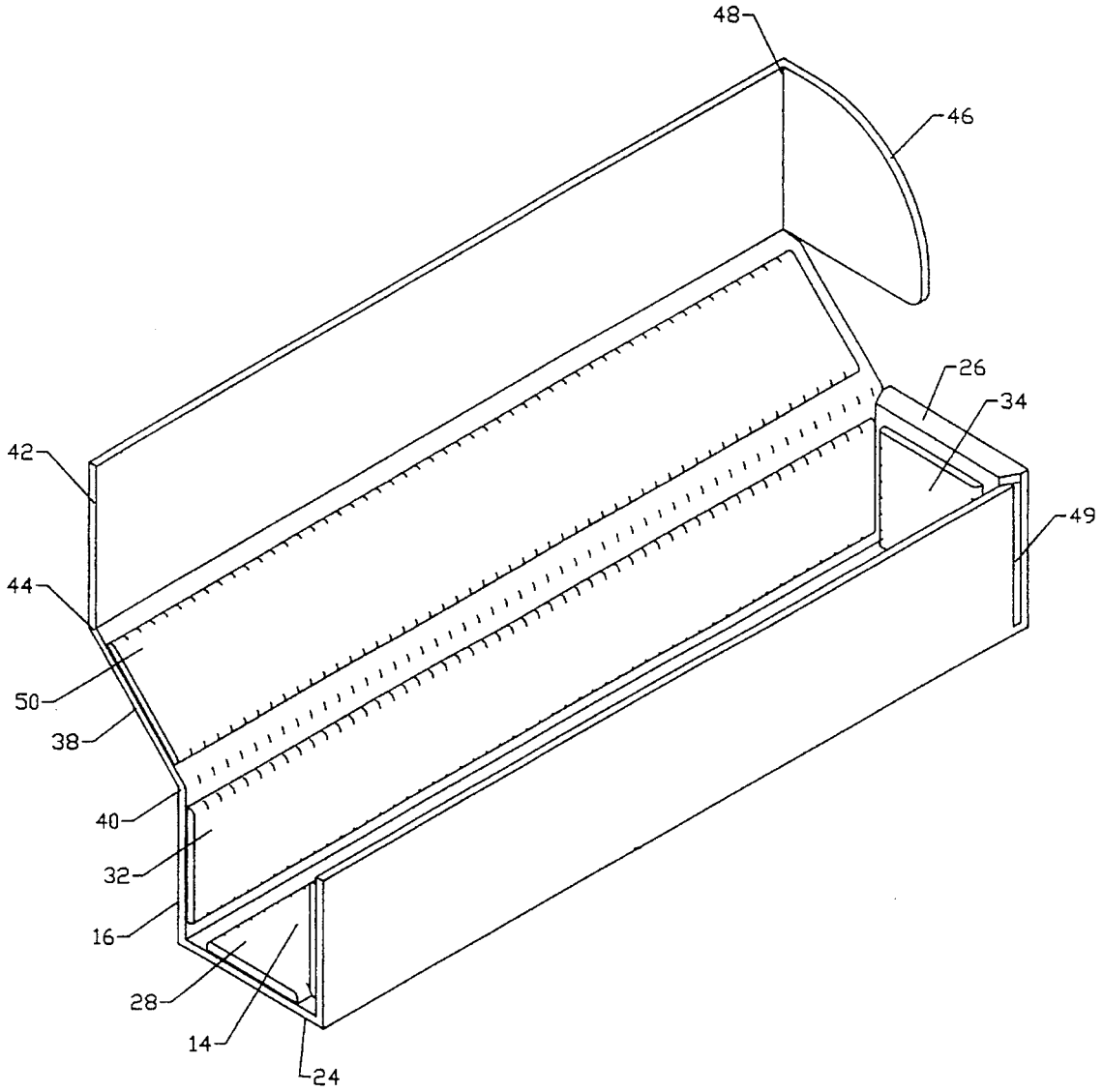
FIG. 3 is a cut away perspective view of an alternate embodiment of the present invention.

FIG. 3 represents another embodiment of the present invention. In this embodiment, a folding lid 38 is connected to an exterior wall 16 at a lid hinge 40. The folding lid 38 is connected to a flap 42 at a flap hinge 44. The flap 42 is connected to a locking member 46 at a locking member hinge 48. When this embodiment is closed, the locking member 46 is inserted into a locking slot 49 which, in this particular embodiment, extends between the end mid-portion 34 and the end wall 26. The folding lid 38 is connected to a folding lid mid-portion 50. In this embodiment, the bottom wall mid-portion 28, exterior wall mid-portion 32 (one not shown), end wall mid-portions 34 (one not shown) and folding lid mid-portion 50 prevent card corners from contacting the container.

It is contemplated that, in one embodiment, this invention can be used to fix the position of the cards relative to the container. For example, in one embodiment, the bottom wall mid-portion 28 and the upper wall mid-portion 50 can be pliant. The bottom wall mid-portion 28 and the upper wall mid-portion 50 can protrude sufficiently to make the chamber 14 slightly shorter than the length of a contained card. When the folding lid 38 is closed, the bottom wall mid-portion 28 will engage the bottom edge of the stored trading cards and the upper wall mid-portion 36 will engage the upper edge of the stored cards. In such an embodiment, each card is in slight compression, which eliminates movement along the card's longitudinal axis and decreases the card's ability to move perpendicular to its longitudinal axis.

The method of the present invention involves placing documents, such as printed or inscribed cards, in a container which has at least one interior surface which has a mid-portion projecting into the interior space of the container. Such mid-portion may be an integral part of the surface or may be separately attached to the surface. Such mid-portion is desirably constructed of a pliant material, as for example, fabric, felt, padding or foam. Plastic foam, such as polyurethane, is preferred. In one embodiment, the mid-portion is a pliant strip attached to a nonrigid backing, which in turn is attached to the container surface. In another embodiment, the mid-portion is a pliant strip attached to a rigid or stiff backing, which in turn is attached to the container surface. In another embodiment, the mid-portion can add support and desirable rigidity to the container wall. In another embodiment, the mid-portion of the lid and the mid-portion of the bottom of the container are made of pliant material, and the container is sized so that when the lid is closed the contained card(s) are placed in slight compression.

The foregoing description is directed to particular embodiments of the invention for the purposes of illustration and explanation. It will be apparent, however, to one of ordinary skill in the art, that many modifications and changes to the embodiments set forth above are possible without departing from the scope and spirit of the invention. It is intended that the following claims be interpreted to embrace all such modifications and changes.

What is claimed is:

1. A document container, comprising:

a plurality of walls defining a chamber, each of said walls having an inside surface; and protruding mid-portions associated with a plurality of said inside surfaces wherein adjacent protruding mid-portions are spaced apart from one another thereby forming a plurality of voids such that every corner of a document stored in said chamber is located in a void and is spaced apart from said protruding mid-portions and said inside surface.

2. The container of claim 1, wherein said protruding mid-portions are pliant.

3. The container of claim 2, wherein said protruding mid-portions are polyurethane foam.

4. The container of claim 1, wherein said walls are formed from a single piece of material.

5. The container of claim 1, wherein said plurality of protruding mid-portions are rigid.

6. A container, comprising:

a chamber formed by a plurality of walls, each wall having an inside surface;

protruding mid-portions associated with a plurality of said inside surfaces, said protruding mid-portions being discontinuous over said inside surface such that a portion of said inside surface of said chamber is exposed; and wherein said protruding mid-portions are adapted to support a document in said chamber such that corners of said document are spaced apart from said protruding mid-portions and said inside surface to prevent damage to said corners.

7. The container of claim 6, wherein said protruding mid-portions are pliant.

8. The container of claim 7, wherein said protruding mid-portions are polyurethane foam.

9. The container of claim 6, wherein said inside surface is formed from a single piece of material.

10. The container of claim 6, wherein each corner of said document is spaced apart from said protruding mid-portions and said inside surfaces.

* * * * *